US005878469A

United States Patent [19]

Wier

[11] Patent Number: 5,878,469

[45] Date of Patent: Mar. 9, 1999

[54] BELT BUCKLE FOR A SEAT BELT

[75] Inventor: Franz Wier, Göggingen, Germany

[73] Assignee: TRW Occupant Restraint Systems GmbH, Alfdorf, Germany

[21] Appl. No.: 958,720

[22] Filed: Oct. 23, 1997

[30] Foreign Application Priority Data

Oct. 23, 1996 [DE] Germany ..... 296 18 509 U

[51] Int. Cl.[6] ..... A44B 11/00

[52] U.S. Cl. ..... 24/633; 24/664

[58] Field of Search ..... 24/633, 641, 323, 24/634, 639, 640, 637, 643, 663, 664; 280/801.1; 297/474, 468, 476, 483

[56] References Cited

U.S. PATENT DOCUMENTS

| | | | |
|---|---|---|---|
| 3,716,895 | 2/1973 | Fohr | 24/664 |
| 4,377,888 | 3/1983 | Ikesue | 24/641 X |
| 4,566,160 | 1/1986 | Gavagan et al. | 24/637 |
| 4,625,371 | 12/1986 | Ueda | 24/639 X |
| 4,945,617 | 8/1990 | Griffith | 24/637 X |
| 5,438,492 | 8/1995 | Collins et al. | 24/633 X |

*Primary Examiner*—Anthony Knight
*Assistant Examiner*—Robert J. Sandy
*Attorney, Agent, or Firm*—Tarolli, Sundheim, Covell, Tummino & Szabo

[57] ABSTRACT

A belt buckle for a seat belt connected to a fitting part having an insert tongue, the buckle includes a load-bearing frame comprising an upper part and a lower part substantially parallel thereto, between which an insert tongue of said fitting part can be received and which are formed by bending of an elongated plate-type part. The upper and the lower parts each having a free end and side edges and being interlocked with each other in the region of their free ends by at least one portion of one of the upper part and the lower part being bent around an adjoining portion of the corresponding other part at each of the two side edges.

9 Claims, 5 Drawing Sheets

BELT BUCKLE FOR A SEAT BELT

TECHNICAL FIELD

The invention relates to a belt buckle for a seat belt and to a stamping for producing a frame for a belt bucke according to the invention.

BACKGROUND OF THE INVENTION

The load-bearing frame of known belt buckles consists usually of a sheet metal stamping which is bent about a middle axis to the extent that an upper part and lower part materialize which, although roughly parallel to each other, are spaced from each other. It is usually the case that spacers are provided on the upper part and lower part, which are intended to prevent the parts from having insufficient spacing from each other. The bent stamping is subsequently tempered. During tempering, the frame spreads apart, and the spacing between upper part and lower part becomes greater at the free ends thereof. This spacing may become so large that the frame is no longer suitable for installing in a belt buckle, and a reject is the result. Such rejects need to be separated out in due time from fully automatic feeding of component parts for assembly.

Furthermore, belt buckle frames or bent stampings are known, the upper and the lower part of which are attached to each other by rivets in order to avoid the frame from spreading apart. However, providing an attachment by rivets is cost-intensive.

BRIEF SUMMARY OF THE INVENTION

The invention provides a belt buckle having a frame, in the manufacture of which the risk of producing frames excessively spread apart can be practically excluded, thus making production of the belt buckle all-in-all more cost-effective. The belt buckle according to the invention for a seat belt connected to a fitting part having an insert tongue includes a load-bearing frame comprising an upper part and a lower part substantially parallel thereto, between which an insert tongue of the fitting part can be received and which are formed by bending of an elongated plate-type part. The upper and the lower parts each having a free end and side edges and being interlocked with each other in the region of their free ends by at least one portion of one of the upper part and the lower part being bent around an adjoining portion of the corresponding other part at each of the two side edges. As a result of this, it is prevented that the spacing between the upper part and the lower part becomes larger during heat treatment. Although the upper part or the lower part may be bent around the corresponding other part along the entire side edge, it is, however, already sufficient when only one portion of the upper part or lower part is bent around an adjoining portion of the corresponding other part in order to define the spacing.

In the preferred embodiment, a laterally protruding first projection serves to connect the upper part to the lower part. The first projection may be bent U-shaped around a second projection which slightly protrudes laterally from the other part. This second projection simultaneously serves in the case of the preferred embodiment as a spacer between the upper part and the lower part by it being angled towards the opposite part.

Fixing the upper part and the lower part to each other may be achieved by providing a first projection an one side edge of the upper part and a first projection at the opposite side edge of the lower part. In this embodiment, the corresponding stamping preferably includes the stamped blanks of several frames which are connected to each other via the projections serving as bridging elements. One projection between adjacent blanks is parted in the vicinity of the one blank, and another projection is parted in the vicinity of the other blank so that the first and second projections can be formed on one side edge. In the case of a stamping configured in this manner, the space between the adjacent blanks may be kept very small which makes production of a frame even more cost-effective.

DETAILED DESCRIPTION OF PREFERRED EMBODIMENTS

Figure 1:
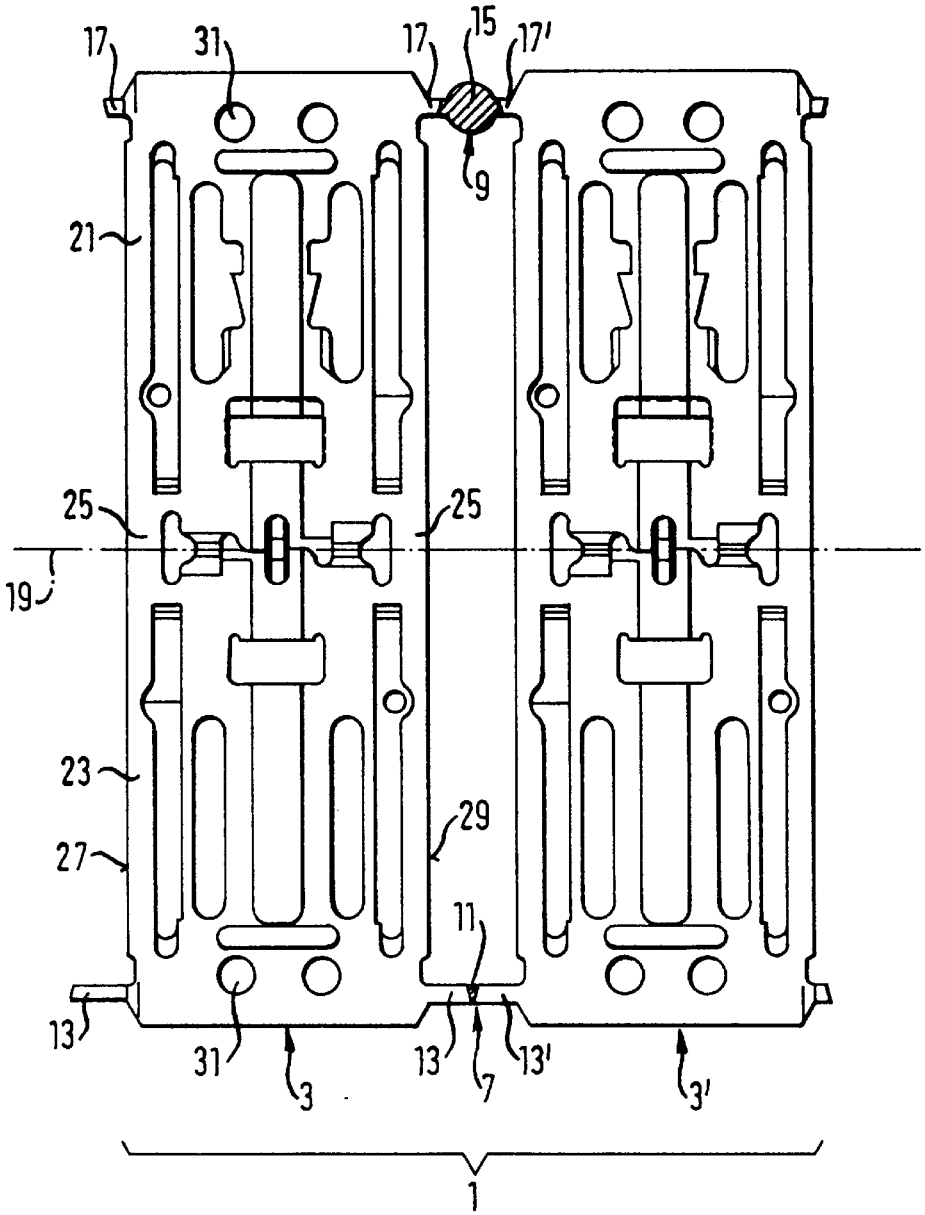
FIG. 1 is a plan view of a part of a stamping showing two contiguous blanks for frames which may be installed in a belt buckle in accordance with a first embodiment.
Figure 2:
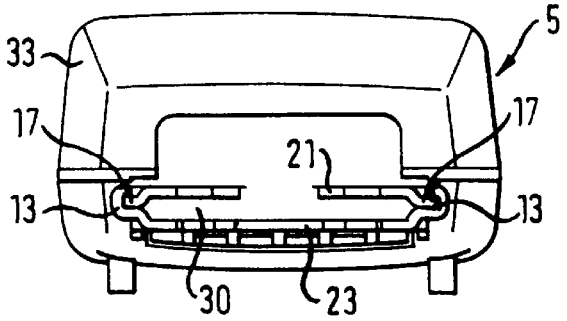
FIG. 2 is a view of the upper front face of the belt buckle in accordance with the first embodiment, in which the frame is highlighted.

In FIG. 1, a part of a stamping 1 having two contiguous stamped blanks for load-bearing frames 3, 3' is shown, of which one is installed in the belt buckle 5 shown in FIG. 2. Each blank has an elongated, plate-shaped form with several recessed and several depressed and raised regions which, however, are not commented on in more detail in the following. The blanks of the frames 3 are connected to each other at their upper and lower ends by bridging elements 7, 9. For parting the blanks, the bridging element 7 is parted in the middle of the region identified by 11, so that at each frame 3, 3' a first projection 13, 13' is formed. Stamped out of the bridging element 9 from the middle thereof is an intermediate piece 15 so that each of the frames 3, 3' features a second projection 17, 17' which, in comparison to the first projection 13, 13', protrudes laterally to a lesser extent. The projections 13, 13' and 17, 17' are equispaced from a middle axis 19 so that the projections 13, 17 and 13' and 17' are disposed one above the other after bending the blank about the middle axis 19. The halves resulting from bending the blanks form an upper part 21 and a lower part 23 which are roughly parallel to each other but spaced from each other and connected by a web 25 recessed centrally. Due to the recess, an insertion opening 31 for the insert tongue of a fitting part materializes, the insert tongue being able to be received between the upper and the lower parts 21, 23.

In the region of the end of the frame 3 opposite the web 25, the second projections 17 for defining the spacing between the upper and the lower parts 21, 23 are angled towards the lower part 23, and the first projections 13 are angled towards the upper part 21 so that they abut each other. Furthermore, the first projections 13 protruding laterally to a greater extent are bent around the second projections 17 (cf. FIG. 2) so that they clasp the second projections 17 in an interfitting manner. The spacing between the upper and lower parts 21, 23 is thus always constant. Even heat treatment after bending of the stamping 3, e.g. in the form of a tempering treatment, does not alter this spacing so that the number of frames lacking dimensional accuracy by having an excessive spacing between the upper and lower parts 21, 23 can be maintained very small.

The frame 3 is fitted in a buckle housing 33 after bending and the corresponding bending-around of the projections 13, 17 as well as subsequent heat treatment. Recesses 31 disposed one above the other (cf. also FIG. 5) in the upper and lower parts 21, 23 serve for riveting the belt buckle 5 to a fastener fitting (not shown).

Figure 3:
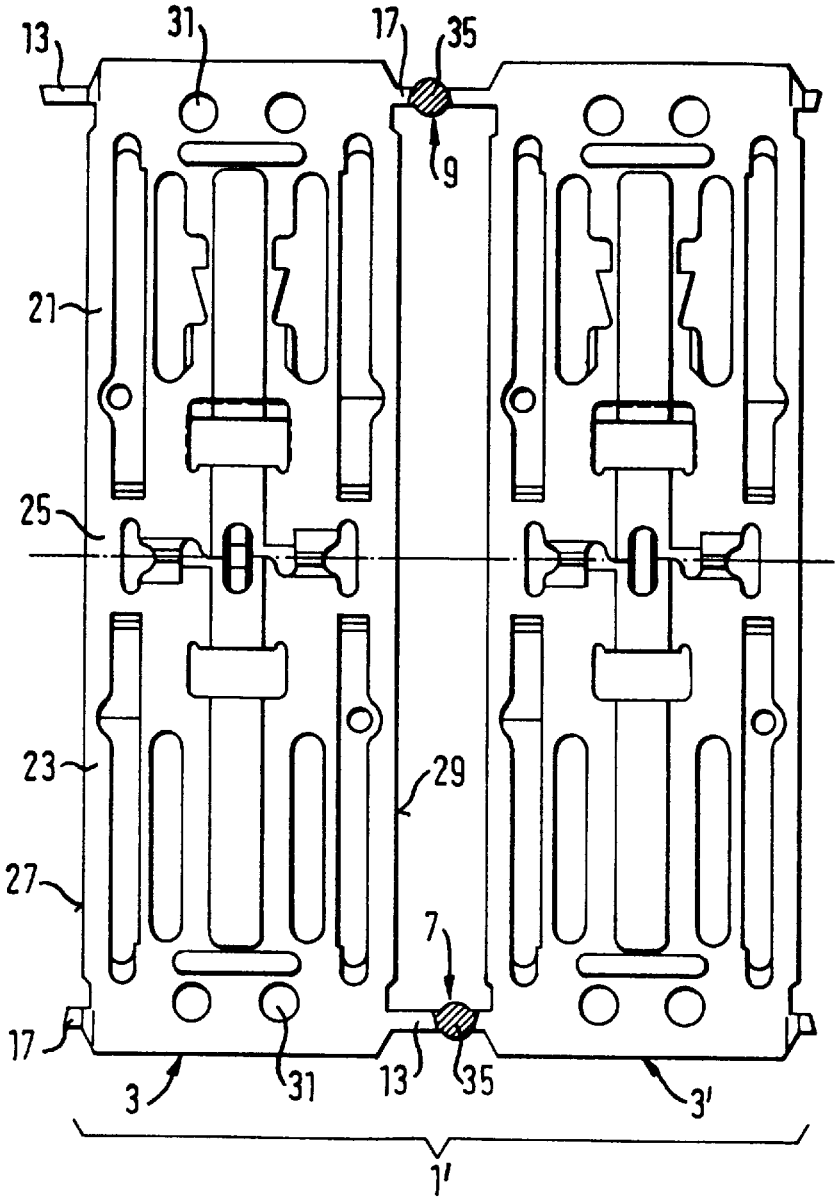
FIG. 3 is a plan view corresponding to that of FIG. 1 of a stamping for a belt buckle in accordance with a second embodiment.

The second embodiment of a stamping 1' shown in FIG. 3 differs from that shown in FIG. 1 by the bridging elements 7, 9 not being halved but by parting the bridging element 7 close to the frame 3' and the bridging element 9 close to the frame 3, as is symbolized by circles 35 indicating cutting or stamping dies. In the region of the side edge 27, the upper part 21 features the projection 13 protruding laterally to a greater extent and the lower part 23 features the projection 17 protruding laterally to a small extent. As a result of this, the projection 13 of the upper part 21 is bent around the projection 17 of the lower part 23 on the side edge 27, and the projection 13 on the lower part 23 is bent around the projection 17 on the upper part 21 in the region of the side edge 29, as is evident from FIG. 4. This configuration has the advantage that as compared to the embodiment shown in FIG. 1 no intermediate piece 15 needs to be stamped out of the back part 9. In the case of projections 13 equal in length, the spacings between two adjacent frames 3, 3' in the stamping 1' shown in FIG. 3 is smaller than that shown in FIG. 1, as a result of which material savings are achieved all-in-all by more frames 3, 3' being able to be produced per stamping.

Figure 6:
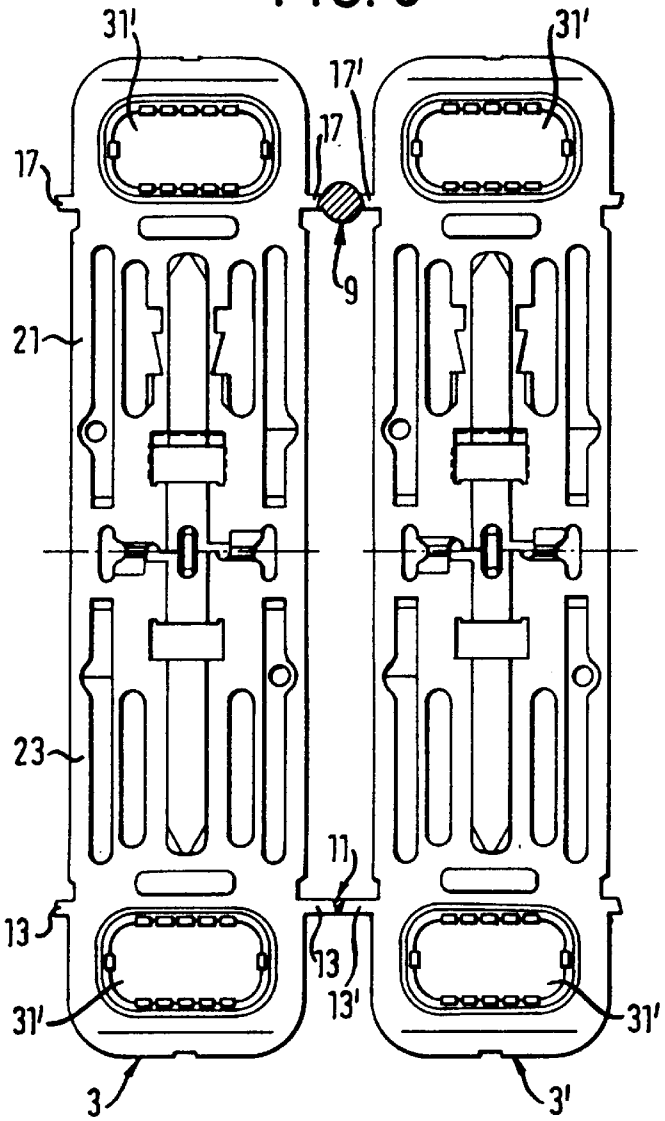
FIG. 6 is a plan view of a section of a stamping which substantially corresponds to that shown in FIG. 1.

The embodiment shown in FIG. 6 features, instead of the recesses 31 provided in the embodiment shown in FIG. 1, a large oblong opening 31' in each upper and lower part 21, 23, which in the case of the bent stamping are arranged one above the other. The openings 31' allow to secure the belt buckle to the vehicle via a belt webbing or via one or more cables.

Figure 4:
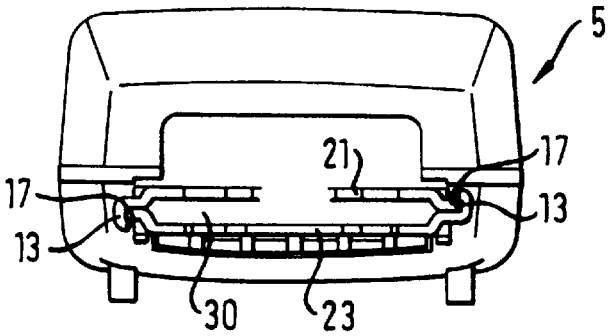
FIG. 4 is a view of the upper face of the belt buckle in accordance with the second embodiment with the frame highlighted.
Figure 5:
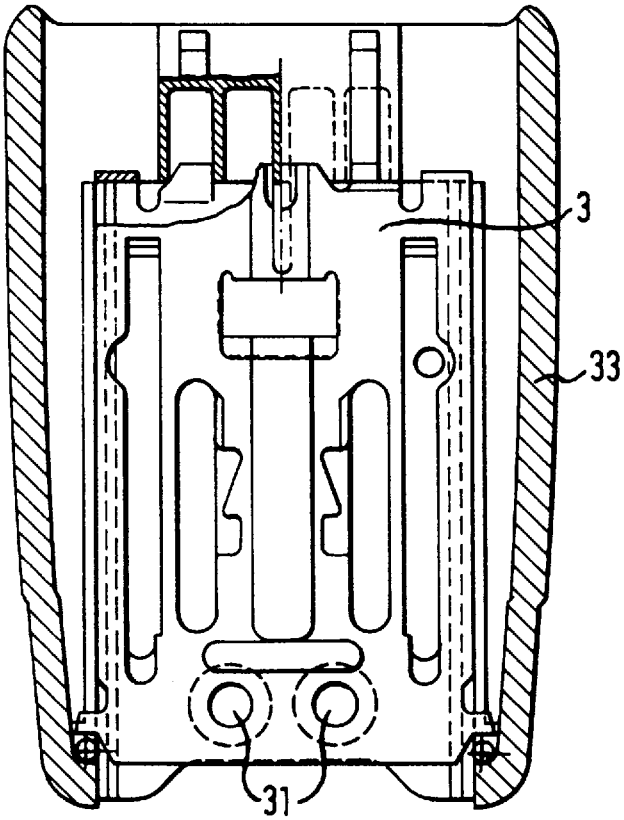
FIG. 5 is a longitudinal section of the belt buckle in accordance with FIG. 4.
Figure 7:
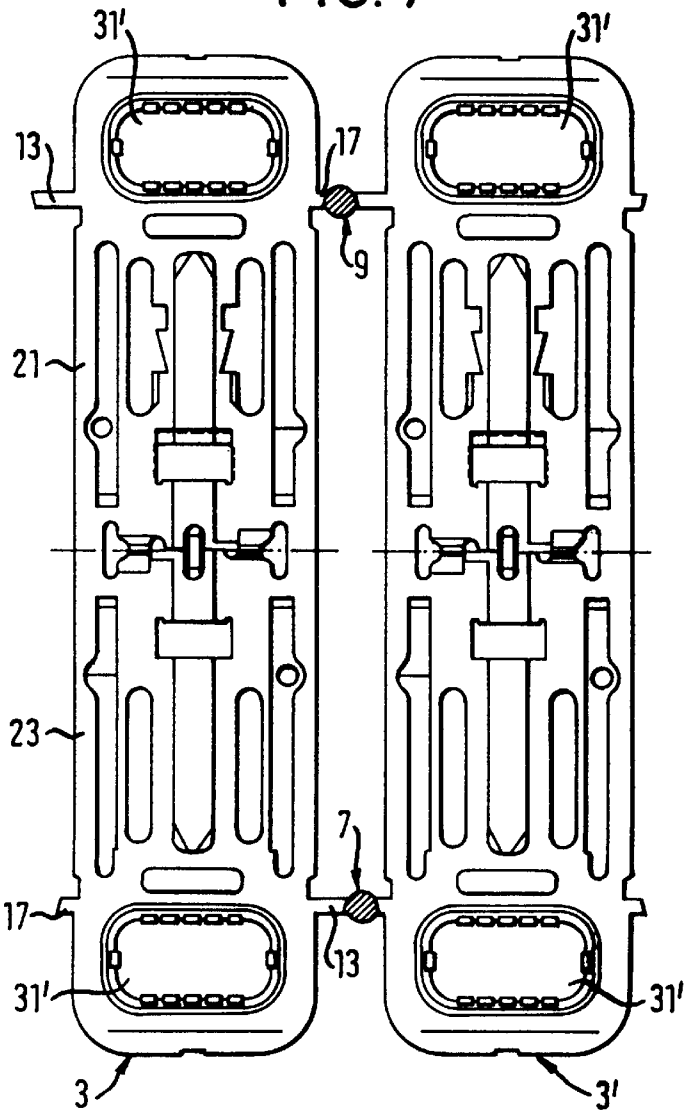
FIGS. 7 to 9 are views of a further embodiment, substantially corresponding to the embodiment shown in FIGS. 3 to 5.
Figure 8:
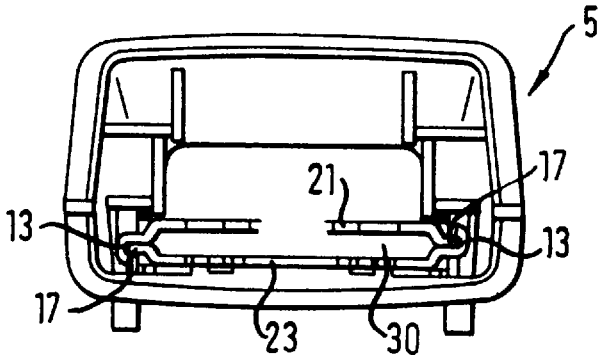
Figure 9:
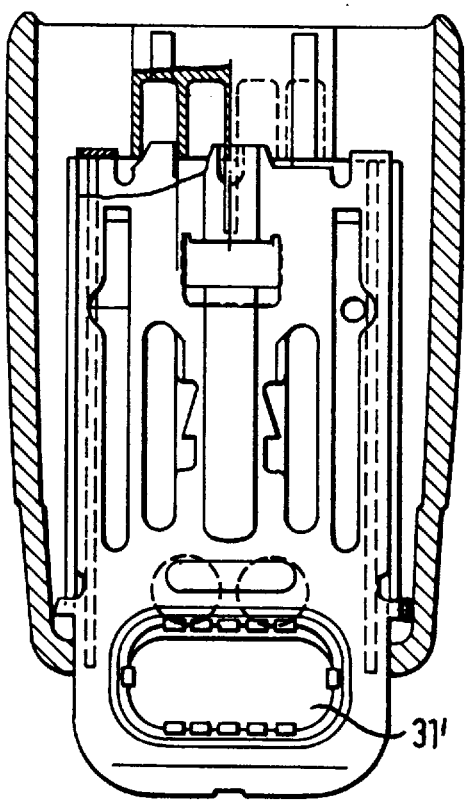

The embodiments shown in the FIGS. 7 to 9 substantially correspond to the embodiments shown in corresponding views in FIGS. 3 to 5. Instead of four openings 31 for securing the belt buckle to a fitting, only two oblong openings 31' are provided through which in the case of this belt buckle too, a belt webbing or a cable can be drawn for attaching the buckle to the vehicle.

In all embodiments and irrespective of the means for connecting the belt buckle to the vehicle, the laterally protruding projects 13, 13', 17, 17' provided for fastening the upper part 21 to the lower part 23 may always be arranged at the same position, the same applying to the projections serving as spacers. As a result of this, the upper parts and lower parts of all stampings shown may be connnected by the same assembly means and incorporated in the same buckle housing so that a module system materializes in which substantially standardized single parts may be differently combined with each other.

I claim:

1. A belt buckle for a seat belt connected to a fitting part having an insert tongue, said buckle including a load-bearing frame made of an elongated plate-type part comprising an upper part and a lower part substantially parallel thereto, between which the insert tongue of the fitting part can be received and which are formed by bending of said elongated plate-type part, said upper and said lower parts each having a free end and side edges and being interlocked with each other in the region of their free ends by one portion at a side edge of one of said upper part and said lower part, said one portion being bent around an adjoining portion at a side edge of the other of said upper part and said lower part, said load bearing frame including a web which connects said upper and said lower parts integrally with each other at an end opposite to said free end and which is slotted centrally in order to receive the insert tongue, and said load-bearing frame further including at least one recess in the region of said free end of said upper and said lower parts for connecting one of a fastener fitting and a fastener belt.

2. The belt buckle as set forth in claim 1, wherein said elongated plate-type part is a stamping.

3. The belt buckle as set forth in claim 1, wherein said one portion bent around said adjoining portion is a first projection which protrudes laterally.

4. The belt buckle as set forth in claim 3, wherein said upper part has a first projection at one of said side edges and said lower part has a second projection at one of said side edges.

5. The belt buckle as set forth in claim 1, wherein spacers are provided between said upper and said lower parts, which are molded to at lest one of said upper and said lower parts.

6. The belt buckle as set forth in claim 5, wherein each spacer is formed by at least one projection on one of said upper part and said lower part which is angled towards the other of said upper part and said lower part.

7. A belt buckle for a seat belt connected to a fitting part having an insert tongue, said buckle including a load-bearing frame made of an elongated plate-type part comprising an upper part and a lower part substantially parallel thereto, between which the insert tongue of the fitting part can be received and which are formed by bending of said elongated plate-type part, said upper and said lower parts each having a free end and side edges and being interlocked with each other in the region of their free ends by a portion at one of said side edges of said lower part and a portion of said upper part at one of said side edges of said upper part being bent around said portion of said lower part.

8. A belt buckle for a seat belt connected to a fitting part having an insert tongue, said buckle including a load-bearing frame made of an elongated plate-type part comprising an upper part and a lower part substantially parallel thereto, between which the insert tongue of the fitting part can be received and which are formed by bending of said elongated plate-type part, said upper and said lower parts each having a free end and side edges and being interlocked with each other in the region of their free ends by one portion at a side edge of one of said upper part and said lower part, said one portion being bent around an adjoining portion at a side edge of the other of said upper part and said lower part, said portion bent around said adjoining portion being a first projection which protrudes laterally, said adjoining portion being a second projection which protrudes laterally, said first projection provided on said one of said upper part and said lower part being bent around said second projection on said other of said upper part and said lower part, said second projection protruding laterally to a lesser extent than said first projection.

9. A stamping for producing a frame for a belt buckle for a seat belt connected to a fitting part having an insert tongue, said buckle including a load-bearing frame made of an elongated plate-type part comprising an upper part and a lower part substantially parallel thereto, between which the insert tongue of the fitting part can be received and which are formed by bending of said elongated plate-type part, said upper and said lower parts each having a free end and side edges and being interlocked with each other in the region of their free ends by one portion at a side edge of one of said upper part and said lower part, said one portion being bent around an adjoining portion at a side edge of the other of said upper part and said lower part, said one portion being a first projection which protrudes laterally, wherein said stamping comprises stamped blanks of a plurality of frames connected to each other by said projections which form bridging elements.

* * * * *